US006592208B2

(12) United States Patent
Tanaka

(10) Patent No.: US 6,592,208 B2
(45) Date of Patent: Jul. 15, 2003

(54) ELECTROSTATIC INK JET HEAD

(75) Inventor: Shinji Tanaka, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 10/186,119

(22) Filed: Jun. 26, 2002

(65) Prior Publication Data

US 2002/0191040 A1 Dec. 19, 2002

Related U.S. Application Data

(62) Division of application No. 09/793,478, filed on Feb. 26, 2001, now Pat. No. 6,511,158.

(30) Foreign Application Priority Data

Mar. 30, 2000 (JP) ..... 2000-095378

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

FOREIGN PATENT DOCUMENTS

JP 7299908 11/1995

*Primary Examiner*—Raquel Yvette Gordon
(74) *Attorney, Agent, or Firm*—Cooper & Dunham, LLP

(57) ABSTRACT

The present invention relates to an electrostatic ink jet head that solves problems caused in a high-frequency driving operation. The electrostatic ink jet head of the present invention includes a nozzle, an ink liquid chamber that communicates with the nozzle, a diaphragm that is employed as a part of the ink liquid chamber and a common electrode, and an individual electrode that faces the diaphragm and is disposed outside the ink liquid chamber, with a predetermined distance being maintained between the individual electrode and the diaphragm. A pulse voltage is applied between the diaphragm and the individual electrode so as to deform the diaphragm by static electricity. The mechanical recovering force caused in the diaphragm prompts the ink droplets to be discharged through the nozzle. One or a plurality of droplets discharged in accordance with an applied pulse form one pixel. Here, the time during which the diaphragm is in contact with the individual electrode is 40% or less of the time required for forming one pixel.

2 Claims, 17 Drawing Sheets

DRIVING PULSE : 10(1,0)(NON-PARALLEL GAP)

(NON-PARALLEL GAP)

(V1 / V = 0.8 : UNSEALED)

(V1 / V = 0.8 : SEALED)

(V1 / V = 0.6 : UNSEALED)

(V1 / V = 0.6 : SEALED)

ELECTROSTATIC INK JET HEAD

This is a divisional of application Ser. No. 09/793,478 filed Feb. 26, 2001 now U.S. Pat. No. 6,511,158. Priority of application No. 2000-095378 filed in Japan on Mar. 30, 2000. Applicant hereby claims priority under 35 U.S.C. §119.

BACKGROUND OF THE INVENTION

1. Field of the Invention

The present invention relates to an electrostatic ink jet head that is provided with a micro-actuator utilizing static electricity.

2. Description of the Related Art

FIG. 1 is a perspective view of a conventional ink jet head that utilizes static electricity. FIG. 2 is a sectional view, taken along the line II—II of FIG. 1, showing the structure of one actuator of the ink jet head shown in FIG. 1. In these figures, reference numeral 10 indicates an electrode substrate, reference numeral 20 indicates a liquid chamber/diaphragm substrate, and reference numeral 30 indicates a nozzle substrate. This nozzle substrate 30 is provided with a nozzle 31, and the liquid chamber/diaphragm substrate 20 is provided with ink liquid chambers 21 that communicate with the nozzle 31. A conductive diaphragm 22 is disposed as a part of the ink liquid chamber 21, and also serves as a part of a common electrode. The diaphragm 22 is thin and has a low rigidity, so as to be flexible. The electrode substrate 10 has individual electrodes 11 outside the ink liquid chambers 21 that are arranged at predetermined intervals. Reference numeral 12 indicates a protection film for preventing short-circuiting between the diaphragm 22 and the individual electrode 11. Reference numeral 13 indicates a sealing member that seals openings in which the individual electrode 11 is disposed. As shown in FIG. 1, the electrostatic ink jet head has a plurality of actuators, and each of the actuators discharges ink droplets.

In FIGS. 1 and 2, a voltage is applied between the diaphragm 22 and the individual electrode 11. The diaphragm 22 is displaced toward the individual electrode 11 due to the static electricity. Here, the applied voltage is turned off to return the diaphragm 22 to the original location at which the diaphragm 22 was situated prior to the application of the voltage. This mechanical behavior of the diaphragm 22 with respect to the static electricity is used for discharging the ink in an electrostatic ink jet apparatus. In FIG. 2, the space between the substrate 20 having the diaphragm 22 and the individual electrode 11 is normally sealed by the sealing member 13 so as to ensure isolation from the outside. This space is called a "gap chamber", and the part of the gap chamber immediately below the diaphragm 22 is referred to as a diaphragm chamber.

When a voltage is applied between the diaphragm 22 and the individual electrode 11 in the electrostatic ink jet head described above, the diaphragm 22 is displaced due to static electricity that acts between the diaphragm 22 and the individual electrode 11. Therefore, the diaphragm 22 is made so thin as to reduce the driving voltage. As a result, the driving voltage can be low, but the rigidity of the diaphragm 22 becomes too low. The existence of air or gas in the diaphragm chamber or the gap chamber has an adverse influence on the behavior of the diaphragm 22. When the diaphragm 22 approaches the individual electrode 11, the diaphragm 22 is subjected to the compressive resistance of the air. As a result, the voltage at the contact point between the diaphragm 22 and the individual electrode 11 (hereinafter referred to as "contact voltage") becomes higher in a dynamic state than in a static state.

There is another problem with the conventional electrostatic ink jet head. FIGS. 3A and 3B illustrate the problem of the conventional electrostatic ink jet head. FIG. 3A shows a displacement D of the diaphragm when the driving frequency is low, and FIG. 3B shows a displacement d of the diaphragm 22 when the driving frequency is high. The diaphragm 22 of the electrostatic ink jet head (Reference numeral 22' indicates the diaphragm 22 displaced and brought in contact with the individual electrode 11.) needs to be dynamically vibrated at a frequency on the order of and up to 10 kHz. The diaphragm chamber is originally small in volume, and the diaphragm 22 moves within the small space. As a result, the diaphragm 22 is subjected to the compressive resistance of the air, and the air is unlikely to return into the diaphragm chamber once it moves out of the diaphragm chamber. If the driving condition (the shape of the driving voltage pulse) is the same, the amount of air moving out of the diaphragm chamber varies with the frequency of the driving voltage pulse. The higher the frequency, the larger the amount of air that cannot return to the diaphragm chamber. As a result, the diaphragm 22 moves closer to the individual electrode 11.

FIG. 6 shows operation results of the conventional electrostatic ink jet head. As shown in FIG. 6, as the frequency becomes higher, the amount of air that cannot return to the diaphragm chamber becomes larger. As a result, the diaphragm 22 is vibrated at a location closer to the individual electrode, as shown in FIG. 3B. Accordingly, the distance between the diaphragm 22 and the individual electrode 11 actually becomes shorter, and the contact voltage becomes lower. In this manner, the frequency characteristics lead to a problem when the frequency becomes high. This phenomenon is peculiar to an electrostatic actuator that drives a diaphragm by static electricity, and should be eliminated when a high-frequency driving operation is carried out.

The above problem arises only when the contact driving operation is performed, with the diaphragm being in contact with the electrodes. In a non-contact driving operation, the above problem of frequency dependence is not caused or can be neglected.

As described before, the diaphragm is subjected to the compressive resistance of the air in the gap chamber in the conventional electrostatic ink jet head. As a result, there will be a problem that the contact voltage increases. To solve this problem, there have been several suggestions. For instance, Japanese Laid-Open Patent Application No. 7-299908 discloses an electrostatic ink jet head in which a space for the air, as well as the diaphragm chamber, is formed in the gap chamber, so that the diaphragm displaced toward the electrodes is not subjected to the compressive resistance of the air. This will result in a larger gap chamber.

However, there has been no suggestion as to a method to solve the problem that arises in a high-frequency driving operation. This is because such a problem is unlikely caused in a conventional electrostatic ink jet head having the maximum driving frequency of 10 kHz, for instance.

SUMMARY OF THE INVENTION

It is a general object of the present invention to provide electrostatic ink jet heads in which the above-mentioned problems are eliminated.

A more specific object of the present invention is to provide an electrostatic ink jet head in which the volume of the diaphragm chamber is relative to the volume of the gap chamber, and the volume of the gap chamber except the diaphragm chamber can be smaller than that in the prior art.

Further specific objects of the present invention are: to improve the frequency dependence of the electrostatic actuator simply by setting the waveform of the driving voltage; to improve the frequency dependence of the electrostatic actuator having a certain gap configuration; to improve the frequency dependence of the electrostatic actuator by changing the structure and configuration; and to improve the frequency dependence of the electrostatic actuator both by changing the structure and configuration and by setting the waveform of the driving voltage.

The above objects of the present invention are achieved by an electrostatic ink jet head that comprises a diaphragm, and an electrode that faces the diaphragm, with a predetermined gap chamber being maintained between the electrode and the diaphragm. In this electrostatic ink jet head, a pulse voltage is applied between the electrode and the diaphragm so as to deform the diaphragm by static electricity. Ink droplets are discharged by a mechanical recovering force of the deformed diaphragm. In this electrostatic ink jet head, one pixel is formed with a pulse voltage. The period of time in which the diaphragm is in contact with the electrode is 40% or less of the period of time required for forming one pixel.

With the electrostatic ink jet head of the present invention, the proportion of the pulse voltage to be applied between the diaphragm and the individual electrode (i.e., the period of time during which the diaphragm is in contact with the electrode) to the period of time required for forming one pixel can be suitably selected. Thus, the frequency characteristics can be greatly improved, and the ink discharging characteristics can be stabilized. Accordingly, the reliability of the electrostatic ink jet head can be increased.

In the electrostatic ink jet head of the present invention, one pixel may be formed with a plurality of pulse voltages.

Also, the electrostatic ink jet head of the present invention may include a plurality of electrostatic actuators. Each of the plurality of electrostatic actuators comprises: a nozzle; an ink liquid chamber that communicates with the nozzle; a diaphragm that is a part of the ink liquid chamber and a part of a common electrode; and an individual electrode that faces the diaphragm and is disposed outside the ink liquid chamber, with a predetermined gap being maintained between the individual electrode and the diaphragm. A pulse voltage is applied between the diaphragm and the individual electrode so as to deform the diaphragm by static electricity, and ink droplets are discharged through the nozzle by a mechanical recovering force generated in the deformed diaphragm. The period of time during which the diaphragm is in contact with the individual electrode is 40% or less of the period of time required for forming one pixel.

The above objects of the present invention are also achieved by an electrostatic ink jet head that comprises a diaphragm, and an electrode that faces the diaphragm, with a predetermined gap being maintained between the electrode and the diaphragm. In this ink jet head, a pulse voltage is applied between the electrode and the diaphragm so as to deform the diaphragm, and ink droplets are discharged by a mechanical recovering force of the deformed diaphragm. Where the volume of the gap chamber is V, and the volume of a diaphragm chamber that is a part of the gap chamber and formed by a space between the diaphragm and the electrode is V1, the relationship, V1/V>0.7, is satisfied.

With the electrostatic ink jet head of the present invention, the ratio of the volume of the diaphragm chamber to the gap chamber can be suitably selected. Thus, the frequency characteristics of the head can be greatly improved, and the ink discharging characteristics can be stabilized. Accordingly, the reliability of the ink jet head can be increased.

The above objects of the present invention are also achieved by an ink jet recording apparatus on which the any one of the above electrostatic ink jet heads is mounted. In this ink jet recording apparatus, the electrostatic ink jet head faces a recording sheet, and discharges ink droplets while reciprocating with respect to the recording sheet, thereby performing a recording operation.

Other objects and further features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 2:
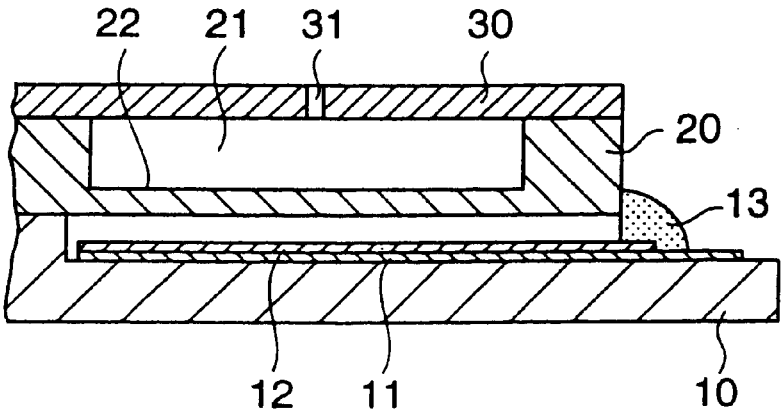
FIG. 2 (Prior Art)
FIG. 2 is a sectional view of one of actuators of the ink jet head, taken along the line II—II of FIG. 1.
Figure 3A:
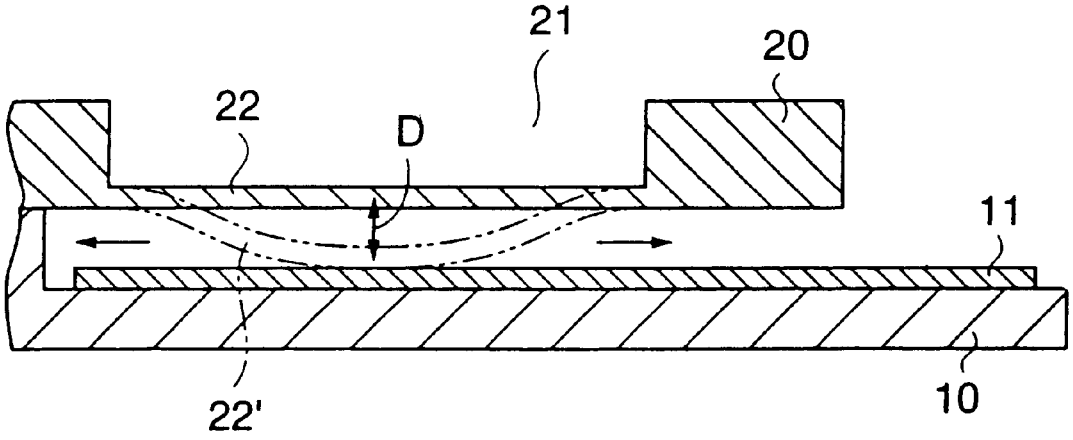
FIG. 3A (Prior Art)
FIGS. 3A and 3B illustrate problems of the conventional electrostatic ink jet head.
Figure 3B:
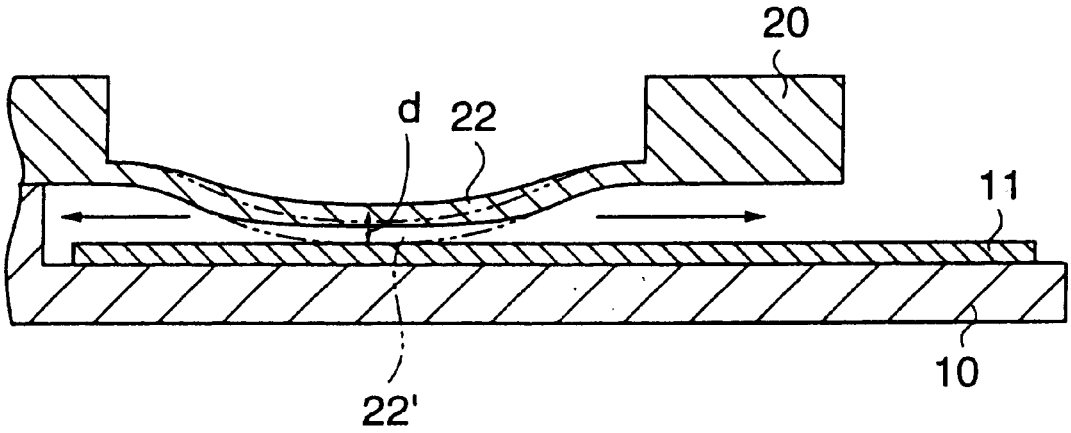
FIG. 3B (Prior Art)

An electrostatic ink jet head of the present invention, as shown in FIG. 2, comprises a nozzle 31, an ink liquid chamber 21 that communicates with the nozzle 31, a diaphragm 22 that is a part of the ink liquid chamber 21 and a part of a common electrode, and individual electrodes 11 that face the diaphragm 22 and are arranged outside the ink liquid chamber 21 at predetermined intervals. A pulse voltage is applied between the diaphragm 22 and the individual electrodes 11, thereby generating static electricity between the diaphragm 22 and the individual electrodes 11. The diaphragm 22 is deformed by the static electricity. The mechanical recovery power, which is generated in the diaphragm 22 when the application of the pulse voltage is stopped, causes ink droplets to discharge through the nozzle 31. The electrostatic ink jet head includes a plurality of electrostatic actuators each having the above structure. In this electrostatic ink jet head, when one pixel is formed by a pulse voltage, the contact time between the diaphragm 22 and the individual electrode 11 is reduced to 40% or less of the time required for forming one pixel, thereby restricting the frequency dependence.

The cause of the frequency dependence was not clear at the beginning. However, it was found from many examples, including the experiment data obtained from Experiment 1 described later, that the above problem is caused by the proportion of time during which the diaphragm 22 stays in contact with the individual electrode 11 to 1-pixel time. More specifically, the frequency dependence is just a part of the dependence on the proportion of the contact time to the 1-pixel time (hereinafter referred to as "contact time/1-pixel time dependence"). In this case, 1-pixel time corresponds to a period of time required for forming one pixel or one dot formed by a plurality of droplets.

Figure 4A:
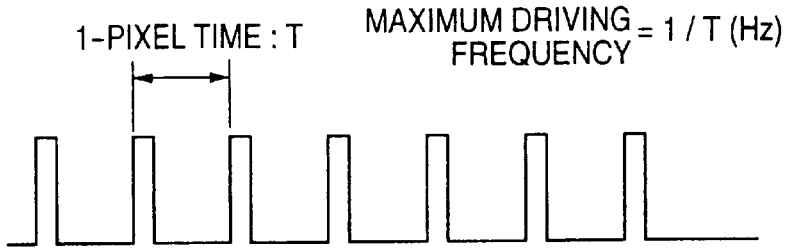
FIGS. 4A to 4C show examples of pulse voltages applied between a diaphragm and an individual electrode.
Figure 4B:
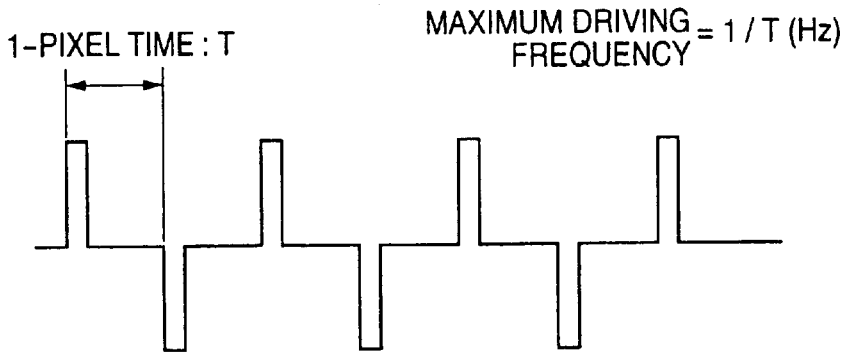
Figure 4C:
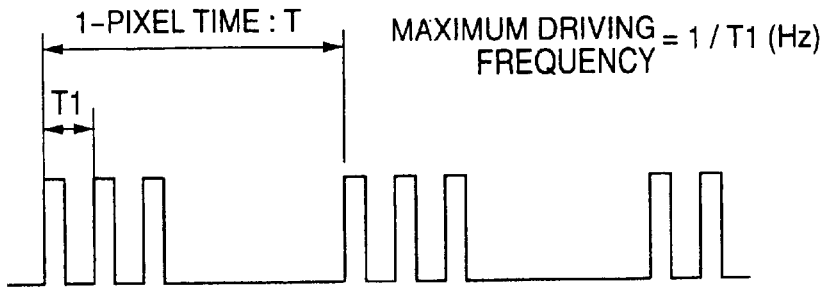

FIGS. 4A, 4B, and 4C illustrate examples of a driving voltage pulse applied between the diaphragm 22 and the individual electrode 11. For one pixel, the driving voltage may be one pulse or a plurality of pulses. FIG. 4A shows a case where only a positive driving pulse is used to form one pixel from one driving pulse. FIG. 4B shows a case where one pulse is formed from a positive and negative pulse (the diaphragm 22 also being displaced with a negative pulse). It should be understood that a positive and negative voltage pulse is applied to remove residual charges characteristic of the electrostatic ink jet head. FIG. 4C shows a case where one pixel is formed from a plurality of voltage pulses (i.e., a plurality of ink droplets). In this case, an ink dot on a recording medium is not necessarily a circle, nor does it have to form a complete dot. A plurality of minute dots may form one pixel. Although not shown in the figures, a voltage that is not 0 may be applied while no ink is being discharged. However, a driving voltage in the present invention is a voltage that brings the diaphragm 22 into contact with the individual electrode 11. In a case of "1 pulse/1 pixel", the diaphragm 22 is brought into contact with the individual electrode 11 once to form one pixel. In a case of "n pulses/1 pixel", the diaphragm 22 is brought into contact with the individual electrode 11 n times to form one pixel. In the cases shown in FIGS. 4A and 4B, the driving condition is "1 pulse/1 pixel", and the maximum driving frequency is indicated by 1/T (T is the period of time required for forming one pixel). Meanwhile, in the case shown in FIG. 4C, the driving condition is "a plurality of pulses/1 pixel", and the maximum driving frequency is 1/T1, instead of 1/T.

In the present invention, the time during which the diaphragm 22 is in contact with the individual electrode 11 is 40% or less of the time required for forming one pixel (i.e., the 1-pixel time T). In the case shown in FIG. 4C, even if the time during which the diaphragm 22 is in contact with the individual electrode is more than 40% of the driving time T1, the frequency dependence can be restricted as long as the total contact time is less than 40% in the 1-pixel time T.

The higher the driving frequency, the narrower the margin to which the driving voltage pulse width can be set. As a result, the optimum pulse width to attain the optimum performance in the ink discharging might not be selected, with structural factors such as the fixed vibration rate and meniscus vibration being considered. However, even if the ink discharging efficiency is slightly lowered, the total ink discharging efficiency and the frequency characteristics are clearly improved with the structure of the present invention.

[First Embodiment]

Figure 1:
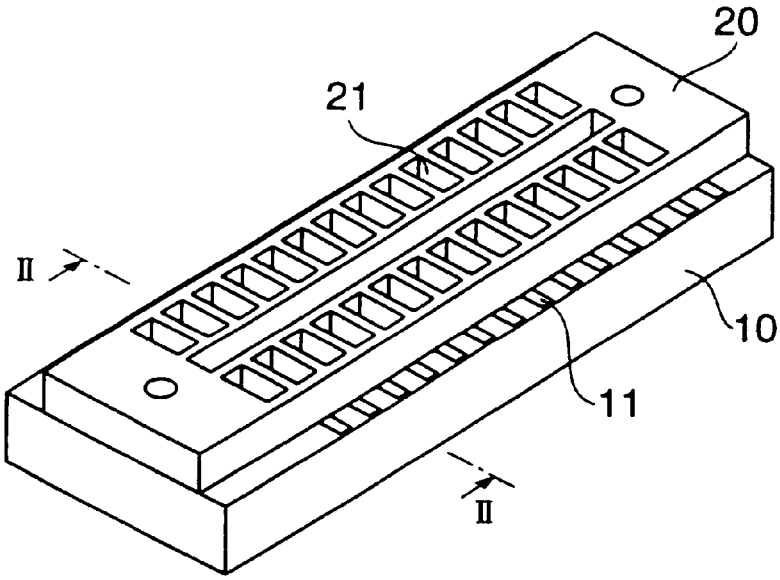
FIG. 1 (Prior Art)
FIG. 1 is a schematic perspective view of a conventional electrostatic ink jet head.

The basic structure of the head is the same as the structure shown in FIGS. 1 and 2. A gap chamber is formed in the electrode substrate 10 by etching, and the individual electrode 11 is formed from TiN. On the individual electrode 11, an $SiO_2$ film is formed as the protection film 12. The liquid chamber 21 is then formed in the Si substrate 20 by etching, and the resultant thin plate serves as the diaphragm 22. The substrates 10 and 20 are then bonded to each other, thereby forming an actuator.

Figure 5A:
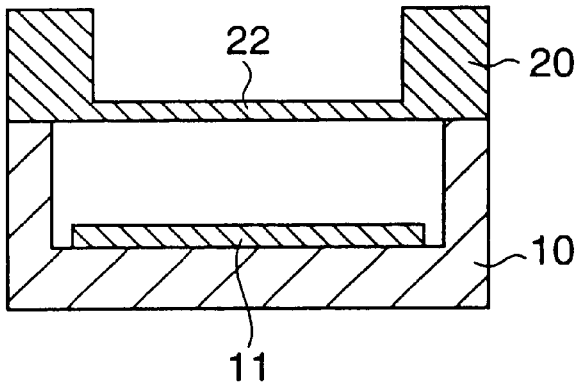
FIGS. 5A to 5C show examples of the gap configuration of an electrostatic ink jet head of the present invention.
Figure 5B:
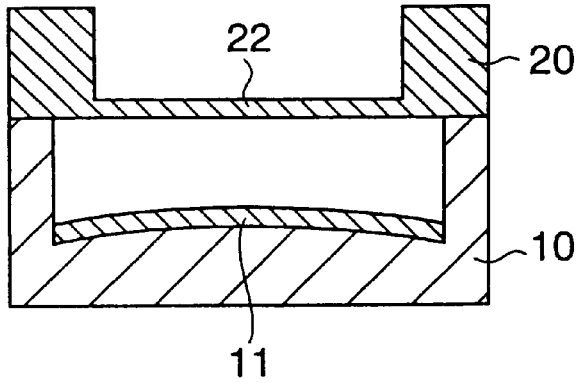
Figure 5C:
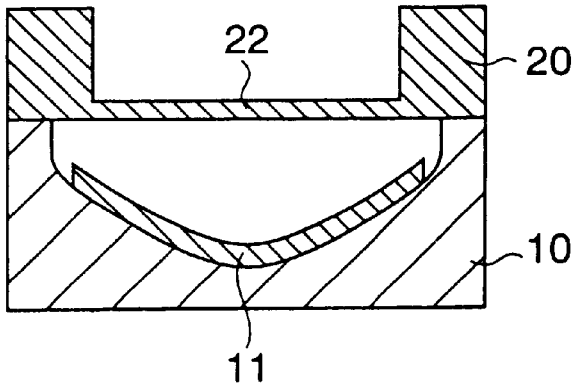

FIGS. 5A to 5C shows examples of the gap configuration in the actuator of the present invention. FIG. 5A shows a case of a parallel gap in which the individual electrode is disposed in parallel with the diaphragm 22. FIG. 5B shows a case of a non-parallel center-convex gap in which the center of the individual electrode 22 is bent toward the diaphragm 22. FIG. 5C shows a case of a non-parallel center-concave gap in which the center of the individual electrode 11 is bent away from the diaphragm 22.

The gap configuration of the actuator of this embodiment is as follows.

Gap between the diaphragm and the electrode:
The parallel gap shown in FIG. 5A Gap length: 0.25 μm Diaphragm thickness: 3 μm Diaphragm area: 130 μm×2000 μm FIGS. 6 to 13 shows the measurement results of the displacement of the diaphragm measured by a laser Doppler vibration meter at the center of the diaphragm 22 in the width direction. The abscissa axis indicates the driving voltage, and the waveform of the driving voltage is rectangular. It should be understood that the driving frequency is the maximum driving frequency in the present invention. In each graph under each driving condition, there is a region in which an increase in displacement is substantially saturated at a voltage that is higher than a certain value. The displacement at the point of saturation is the contact displacement.

Evaluation

Figure 6:
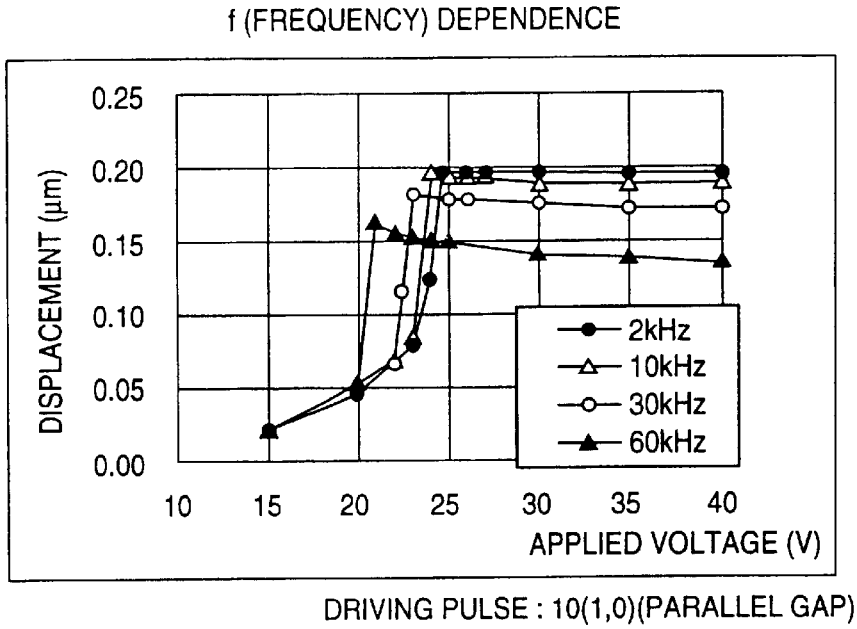
FIG. 6 shows a frequency dependence in an electrostatic ink jet head having a parallel gap configuration (the relationship between a pulse voltage and a diaphragm displacement, with frequency being the parameter)
Figure 7:
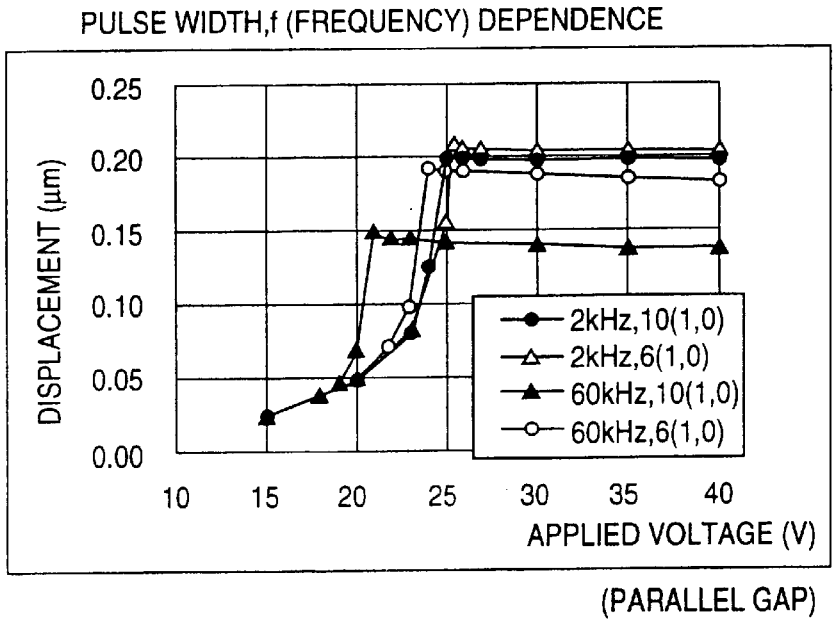
FIG. 7 shows a pulse width and frequency dependence in an electrostatic ink jet head having a parallel gap configuration (the relationship between a pulse voltage and a diaphragm displacement, with frequency having varied pulse widths being the parameter)

As shown in FIG. 6, when the driving pulse conditions (the rising pulse Pr=1 μs, the pulse width Pw=10 μs, and the falling pulse Pf=0 μs: hereinafter indicated as "10 (1, 0)") are the same, as the frequency becomes higher, the displacement caused while the diaphragm is in contact with the individual electrode 11 (hereinafter referred to as "contact displacement") decreases, and the contact voltage drops. However, this is more of the "contact time/1-pixel time" dependence than the frequency dependence, as mentioned before. Accordingly, as shown in FIG. 7, the width of the driving voltage pulse is set at 40% or less of the 1-pixel time (which is 16.6 μs at 60 kHz; 6 μs in FIG. 7). With this pulse width, even if the driving frequency is 60 kHz, a decrease of the contact displacement can be restricted to 10% of the contact displacement at 2 kHZ, as shown in FIG. 7. Such a small decrease is allowable during an ink discharging operation. Here, the width of the driving voltage pulse substantially corresponds to the contact time under proper conditions.

In the actuator, the optimum pulse width of the driving voltage varies with the discharge efficiency that is determined by the amount of discharged ink and the ink fluid characteristics. However, the pulse width should preferably be in the range of 5 to 20 μs. In FIG. 6, the driving voltage has a pulse width of 10 μs. In this case, the contact displacement at 30 kHz, at which the contact time is 33% of the 1-pixel time, decreases by 15% of the contact displacement at 2 kHz. With the pulse width being up to 20 μs, the contact displacement caused at 20 kHz or higher might decrease by 10% of more of the contact displacement caused at 2 kHz. A 10% decrease of the contact displacement has substantially no adverse influence on the ink discharging efficiency, but a 15% or more decrease adversely influences the ink discharging efficiency. If the contact displacement decreases by 30%, the ink discharging characteristics clearly change.

Since the contact time, during which the diaphragm 22 is in contact with the individual electrode 11, is 20% or less of the 1-pixel time, the "contact time/1-pixel time" dependence can be effectively restricted, regardless of the gap configuration between the diaphragm 22 and the individual electrode 11.

When the gap configuration is the parallel gap or the non-parallel center-convex gap, as shown in FIGS. 5A and 5B, a sufficient improvement in the "contact time/1-pixel time" dependence can be made under the driving condition of 40% or less contact time. However, in the case where the maximum gap length is at the center of the diaphragm 22 as shown in FIG. 5C, or in a case where the gap length in the parallel gap configuration is as small as 0.3 μm or less, a sufficient improvement in the "contact time/1-pixel time" dependence cannot be made even under the driving condition of 40% or less contact time. For one conceivable reason, since the rate of the diaphragm chamber volume V1*a* at the time of contact to the diaphragm chamber volume V1 at the time when the voltage is off in the actuator is small, the influence of the air escaping from the diaphragm chamber is relatively large. In this manner, the contact time is made 20% or less of the 1-pixel time, so that the "contact time/1-pixel time" dependence can be restricted regardless of the gap configuration.

As the maximum frequency is made higher, the ink discharging efficiency of the actuator at a low frequency becomes lower because the pulse width is made narrower so as to reduce the contact time to 20% or less. In accordance with the present invention, the total ink discharging efficiency and the frequency characteristics improve significantly.

In the structure shown in FIG. 5B, the compression resistance of the air on the diaphragm can be easily reduced when the diaphragm 22 is brought into contact with the individual electrode 11. To reduce the compression resistance, an escape chamber for the air needs to be created. As disclosed in Japanese Laid-Open Patent Application No. 7-299908, such an escape chamber is more effectively created in the diaphragm chamber than in the gap chamber outside the diaphragm chamber, because the air cannot flow as fast as the movement of the diaphragm 22 and the gap chamber hinders the air from having lowered compression resistance. Further, the air that has once escaped from the diaphragm chamber rarely returns into the diaphragm chamber, and accordingly, the "contact time/1-pixel time" dependence is caused in the actuator. To reduce the compression resistance of the air, the part of the electrode that faces the center portion of the diaphragm in the width direction, which can exert static electricity most effectively upon the diaphragm, is brought most close to the diaphragm. Therefore, the structure shown in FIG. 5B is effective.

[Second Embodiment]

The basic structure of the head of a second embodiment is the same as the structure shown in FIGS. 1 and 2. A gap chamber is formed in the electrode substrate 10 by etching, and the individual electrode 11 is formed from TiN. On the individual electrode 11, an $SiO_2$ film is formed as the protection film 12. The liquid chamber 21 is then formed in the Si substrate 20 by etching, and the resultant thin plate serves as the diaphragm 22. The substrates 10 and 20 are then bonded to each other, thereby forming an actuator.

The gap configuration of the actuator of this embodiment is as follows.

Gap between the diaphragm and the electrode:

The non-parallel center-concave gap shown in FIG. 5C

Gap length: 0.3 μm

Diaphragm thickness: 3 μm

Diaphragm area: 130 μm×3000 μm

Evaluation

Figure 8:
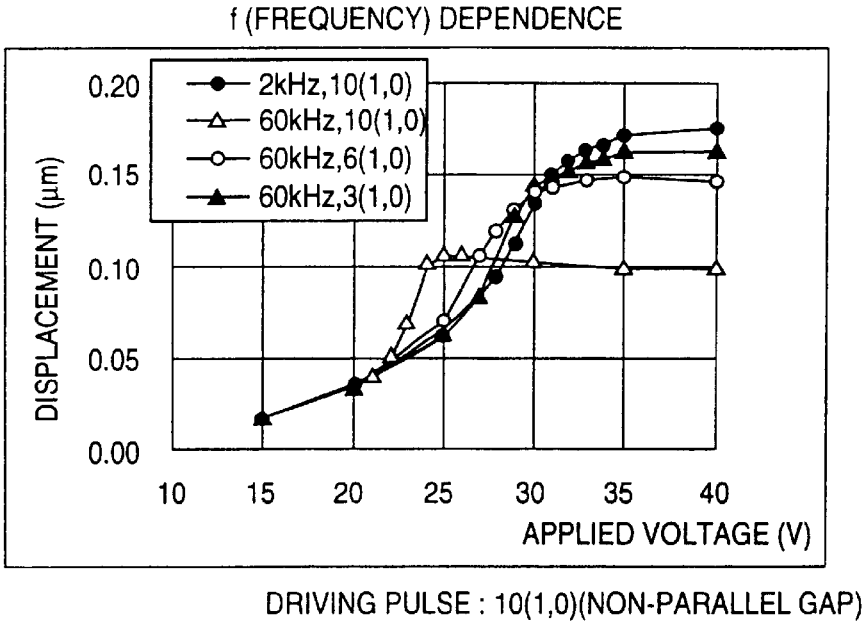
FIG. 8 shows a frequency dependence in an electrostatic ink jet head having a non-parallel gap configuration (the relationship between a pulse voltage and a diaphragm displacement, with frequency being the parameter)
Figure 9:
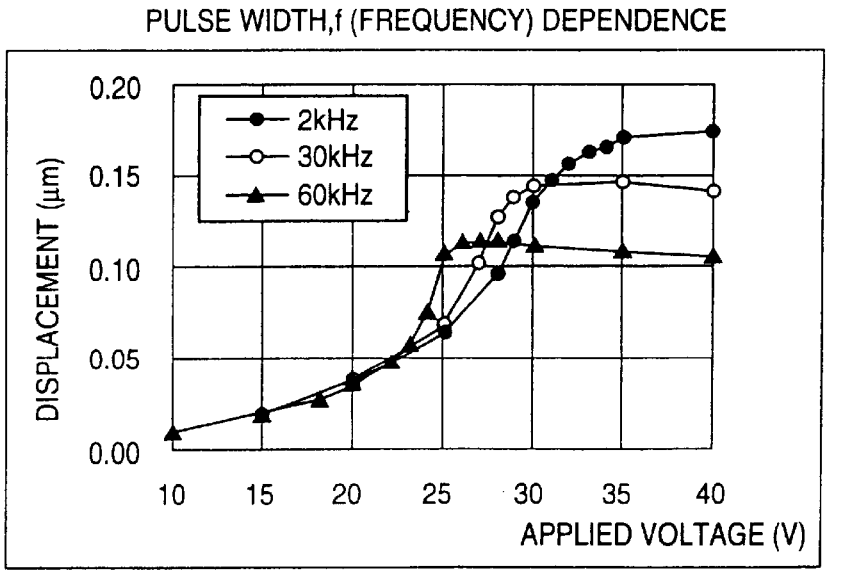
FIG. 9 shows a pulse width and frequency dependence in an electrostatic ink jet head having a non-parallel gap configuration (the relationship between a pulse voltage and a diaphragm displacement, with frequency having varied pulse widths being the parameter)

As shown in FIG. 8, when the driving pulse conditions (the rising pulse Pr=1 μs, the pulse width Pw=10 μs, and the falling pulse Pf=0 μs: hereinafter indicated as "10 (1, 0)") are the same, as the frequency becomes higher, the displacement caused while the diaphragm is in contact with the individual electrode 11 (hereinafter referred to as "contact displacement") decreases, and the contact voltage drops. This is the "contact time/1-pixel time" dependence, which is larger than that in the results of the actuator having the parallel gap configuration shown in FIG. 6. Furthermore, the displacement continuously increases at a certain voltage in FIG. 8, while the displacement discontinuously increases in FIG. 6. In FIG. 9, the width of the driving voltage pulse is set at 40% or less of the 1-pixel time (which is 16.6 μs at 60 kHz; 6 μs in FIG. 9). With this pulse width, the contact displacement decreases by 10% or more with respect to the contact displacement at 2 kHz (although the pulse width is 10 μs in FIG. 9), and the contact voltage also dramatically drops. As a result, the ink discharging characteristics change in a drastic manner. Meanwhile, in a case where the pulse width is 20% or less of the 1-pixel time (3 μs in FIG. 9), even if the driving frequency is 60 kHz, a decrease of the contact displacement can be restricted to 10% of the contact displacement at 2 kHZ, and the contact voltage hardly changes. Such a small decrease is allowable during an ink discharging operation. Here, the width of the driving voltage pulse substantially corresponds to the contact time under proper conditions.

In this embodiment, the relationship, V1/V>0.7, is satisfied, where the volume of the gap chamber, which is the space formed by the substrate 10 and the sealing member 13, is V, and the volume of the diaphragm chamber, which is the space between the individual electrode 11 and the diaphragm 22, is V1. Accordingly, the "contact time/1-pixel time" dependence can be greatly improved.

Since the space in the gap chamber besides the diaphragm chamber is small, there is no space for the air to escape to when the diaphragm 22 is vibrated. As a result, the air can hardly escape from the diaphragm chamber.

Accordingly, it is most desirable to satisfy the relationship V1/V=0.0, which is difficult realistically. Therefore, the relationship, V1/V>0.7, should at least be satisfied to achieve sufficient effects.

It should be understood here that the gap chamber includes the diaphragm chamber and is separated from the outside by the sealing member 13.

[Third Embodiment]

The basic structure of the head of a third embodiment is the same as the structure shown in FIGS. 1 and 2. A gap chamber is formed in the electrode substrate 10 by etching, and the individual electrode 11 is formed from TiN. On the individual electrode 11, an $SiO_2$ film is formed as the protection film 12. The liquid chamber 21 is then formed in the Si substrate 20 by etching, and the resultant thin plate serves as the diaphragm 22. The substrates 10 and 20 are then bonded to each other, thereby forming an electrostatic ink jet head. After the bonding, an actuator having the opening of the gap chamber sealed by epoxy-containing adhesive 13 is formed, as well as an actuator having no sealing member.

The gap configuration of the ink jet head of this embodiment is as follows.

Gap between the diaphragm and the electrode:

The non-parallel center-concave gap shown in FIG. 5C

Gap length: 0.3 μm

Diaphragm thickness: 3 μm

Diaphragm area: 130 μm×3000 μm

The opening of the gap chamber is sealed so that the actuators each have a diaphragm chamber having a volume of 0.8 or 0.6, with the volume of the gap chamber being 1.0. The gap chamber of an unsealed actuator is situated at the location corresponding to the gap chamber of a sealed actuator.

Evaluation

Figure 10:
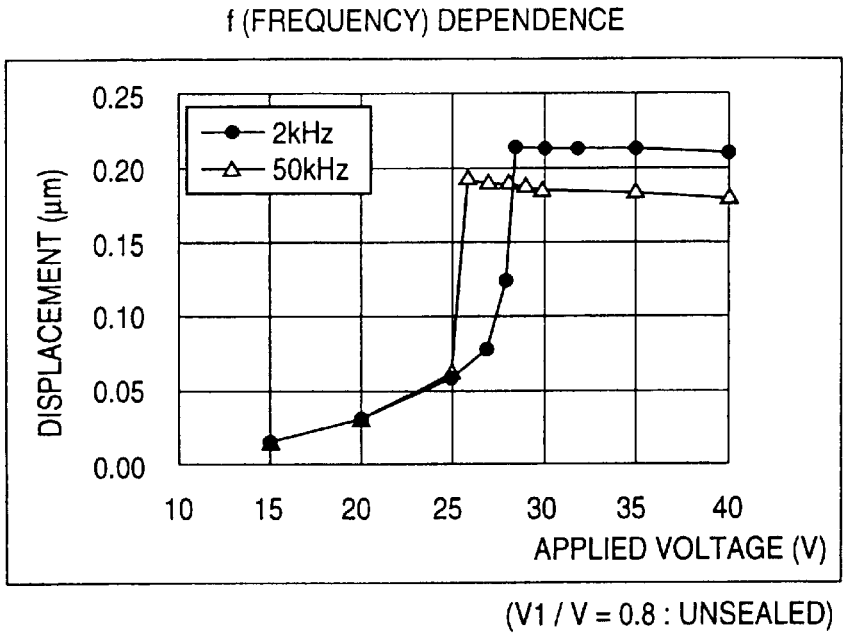
FIG. 10 shows a frequency dependence in an electrostatic ink jet head having an unsealed gap chamber (V1/V=0.8)
Figure 11:
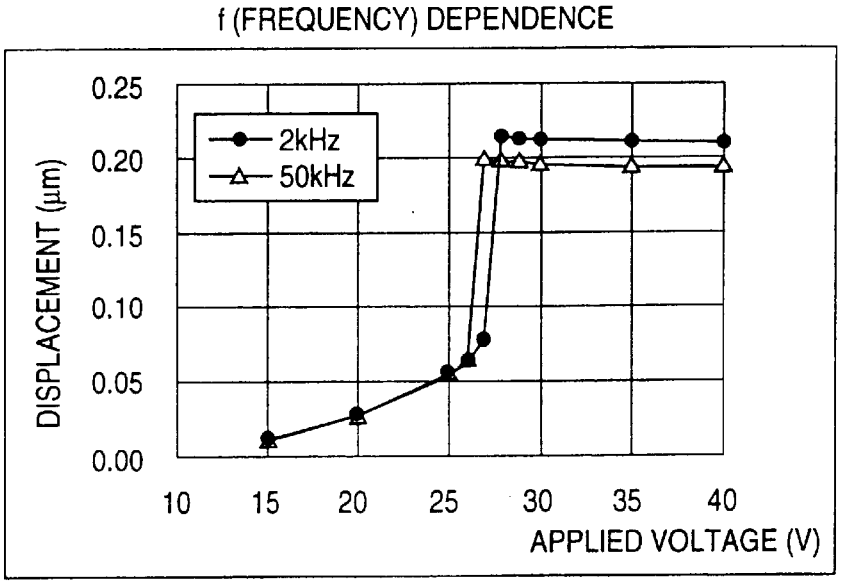
FIG. 11 shows a frequency dependence in an electrostatic ink jet head having a sealed gap chamber (V1/V=0.8)
Figure 12:
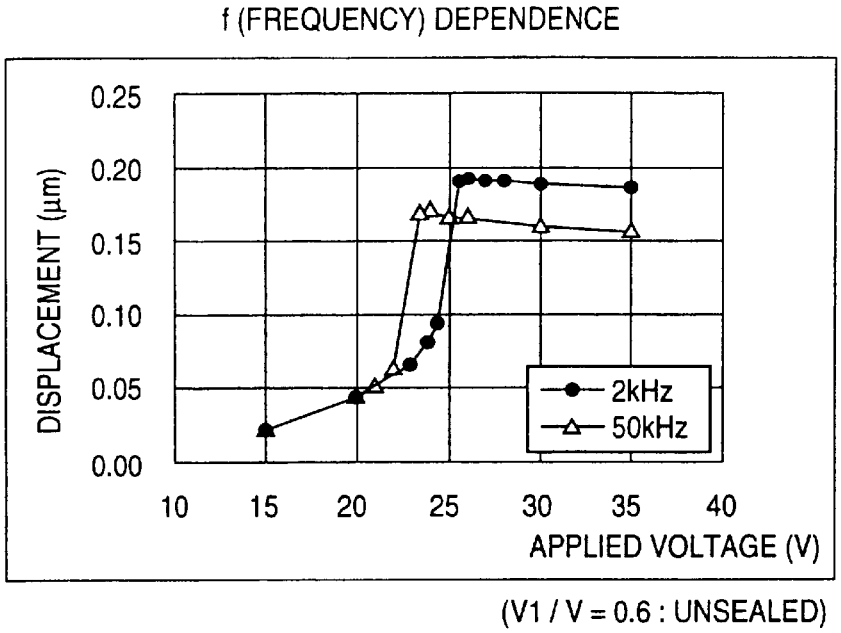
FIG. 12 shows a frequency dependence in an electrostatic ink jet head having an unsealed gap chamber (V1/V=0.6)
Figure 13:
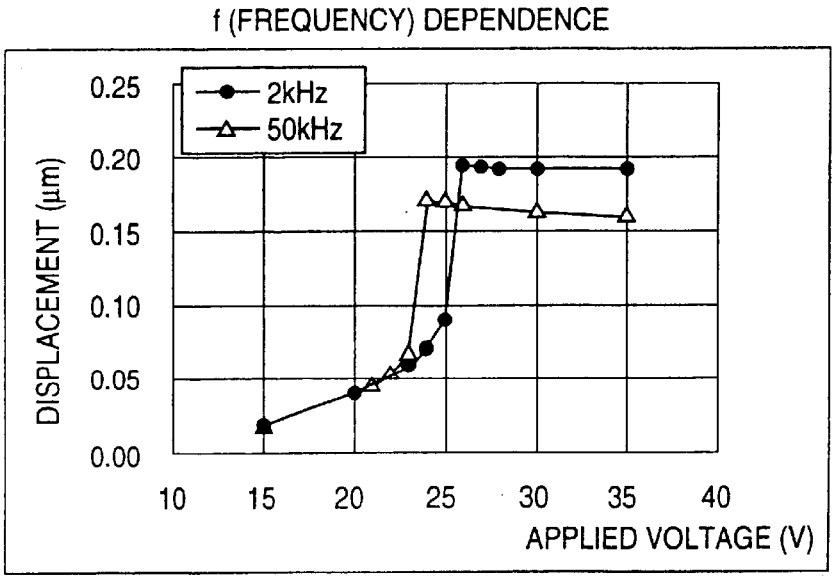
FIG. 13 shows a frequency dependence in an electrostatic ink jet head having a sealed gap chamber (V1/V=0.6)

FIGS. 10 and 11 show evaluation results of actuators having the ratio of the diaphragm chamber to the gap chamber, V1/V=0.8. FIG. 10 shows a case of an unsealed actuator, and FIG. 11 shows a case of a sealed actuator. FIGS. 12 and 13 show evaluation results of actuators having the ratio of the diaphragm chamber to the gap chamber, V1/V=0.6. FIG. 12 shows a case of an unsealed actuator, and FIG. 13 shows a case of a sealed actuator.

As shown in FIGS. 10 and 11, as long as the condition, V1/V=0.8, is satisfied, a sufficient improvement can be made in the frequency dependence, i.e., the "contact time/1-pixel time" dependence. Under this condition, the ink discharging characteristics can be restricted within an allowable range.

On the contrary, as can be seen from FIGS. 12 and 13, when V1/V is 0.6, no improvement can be made in the frequency dependence, i.e., the "contact time/1-pixel time" dependence.

The time during which the diaphragm 22 is in contact with the individual electrode 11 is 40% or less of the time required for forming one pixel (1-pixel time). The volume of the gap chamber formed by the substrate 20 and the sealing member 13 is V, and the diaphragm chamber formed in the space between the individual electrode 11 and the diaphragm 22 is V1. Here, the relationship, V1/V>0.7, should be satisfied so as to make a great improvement in the "contact time/1-pixel time" dependence.

In a region where the maximum driving frequency is high, i.e., where the frequency is 20 kHz or higher, the time during which the diaphragm 22 is in contact with the individual electrode 11 is 20% or less of the time required for forming one pixel. The volume of the gap chamber formed by the substrate 20 and the sealing member 13 is V, and the diaphragm chamber formed in the space between the individual electrode 11 and the diaphragm 22 is V1. Here, the relationship, V1/V>0.7, should be satisfied so as to make a great improvement in the "contact time/1-pixel time" dependence.

Figure 14:
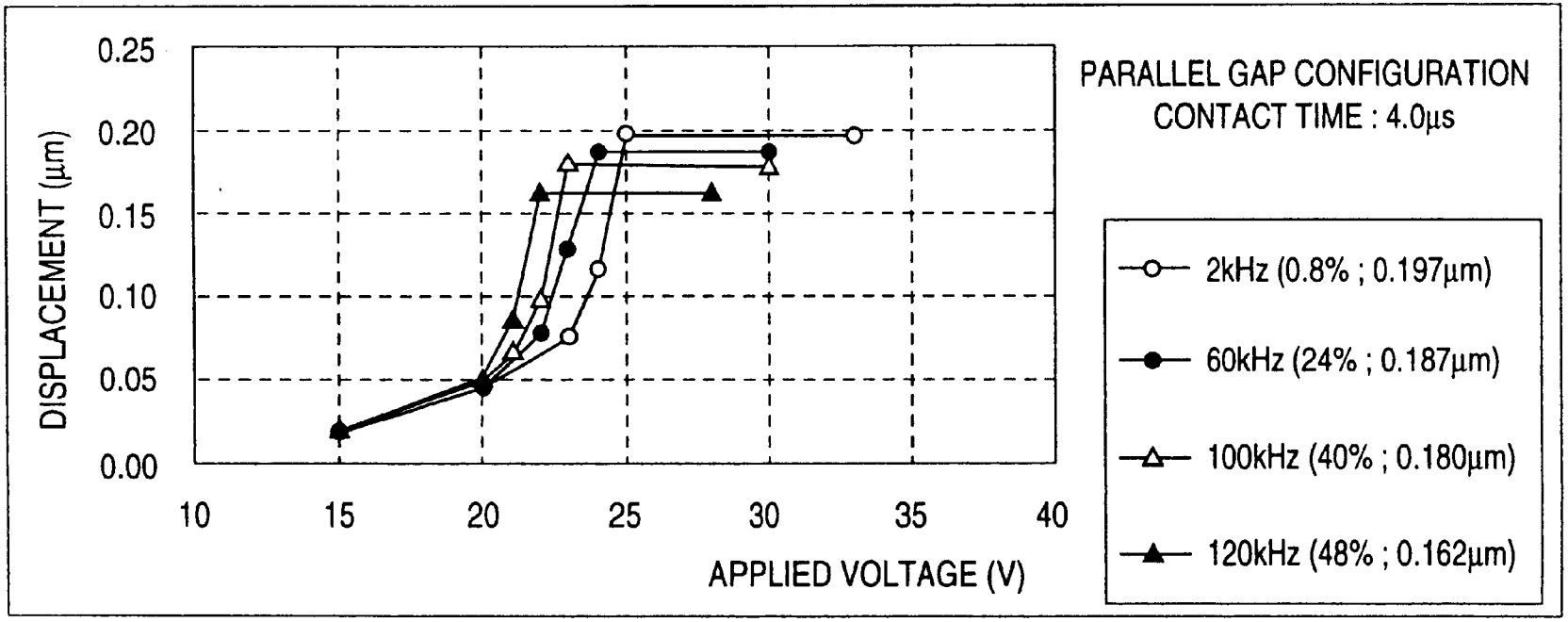
FIG. 14 shows a frequency dependence in an electrostatic ink jet head having a parallel gap configuration and a contact time of 4.0 $\mu$s.
Figure 15:
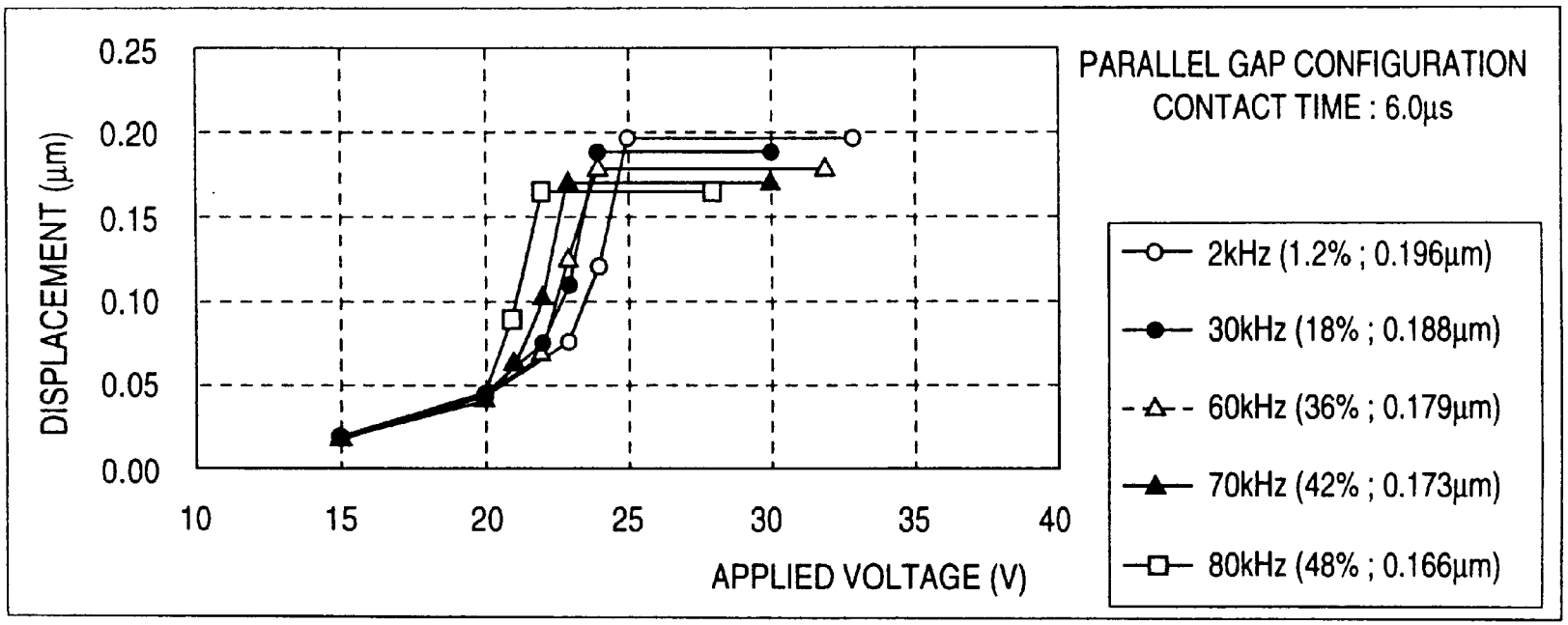
FIG. 15 shows a frequency dependence in an electrostatic ink jet head having a parallel gap configuration and a contact time of 6.0 $\mu$s.
Figure 16:
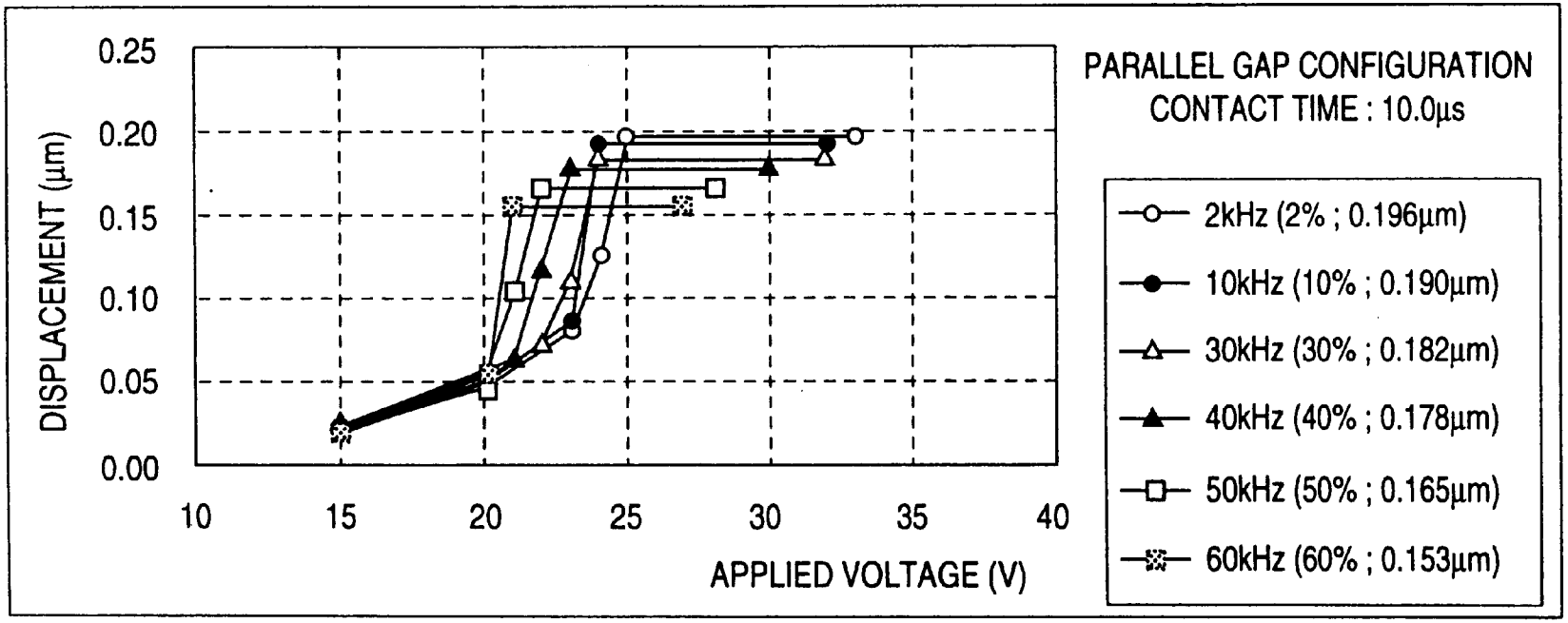
FIG. 16 shows a frequency dependence in an electrostatic ink jet head having a parallel gap configuration and a contact time of 10.0 $\mu$s.
Figure 17:
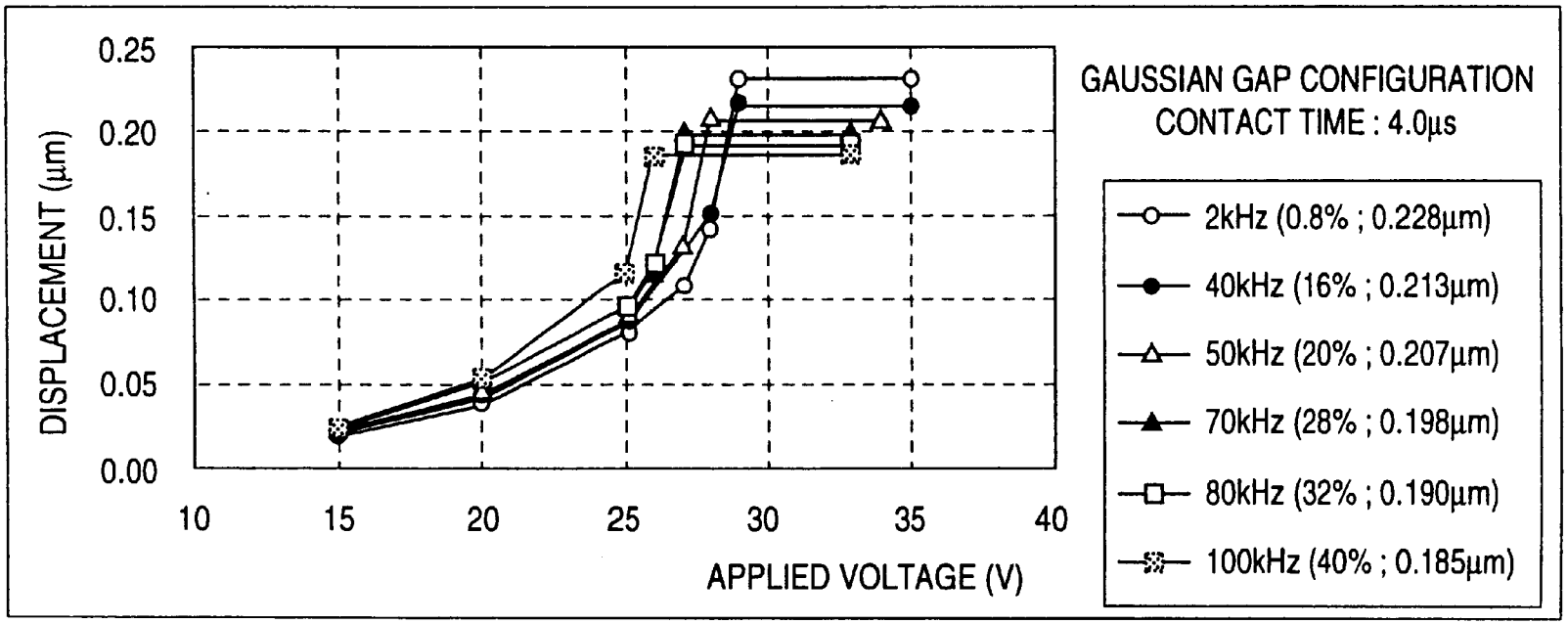
FIG. 17 shows a frequency dependence in an electrostatic ink jet head having a Gaussian gap configuration and a contact time of 4.0 $\mu$s.
Figure 18:
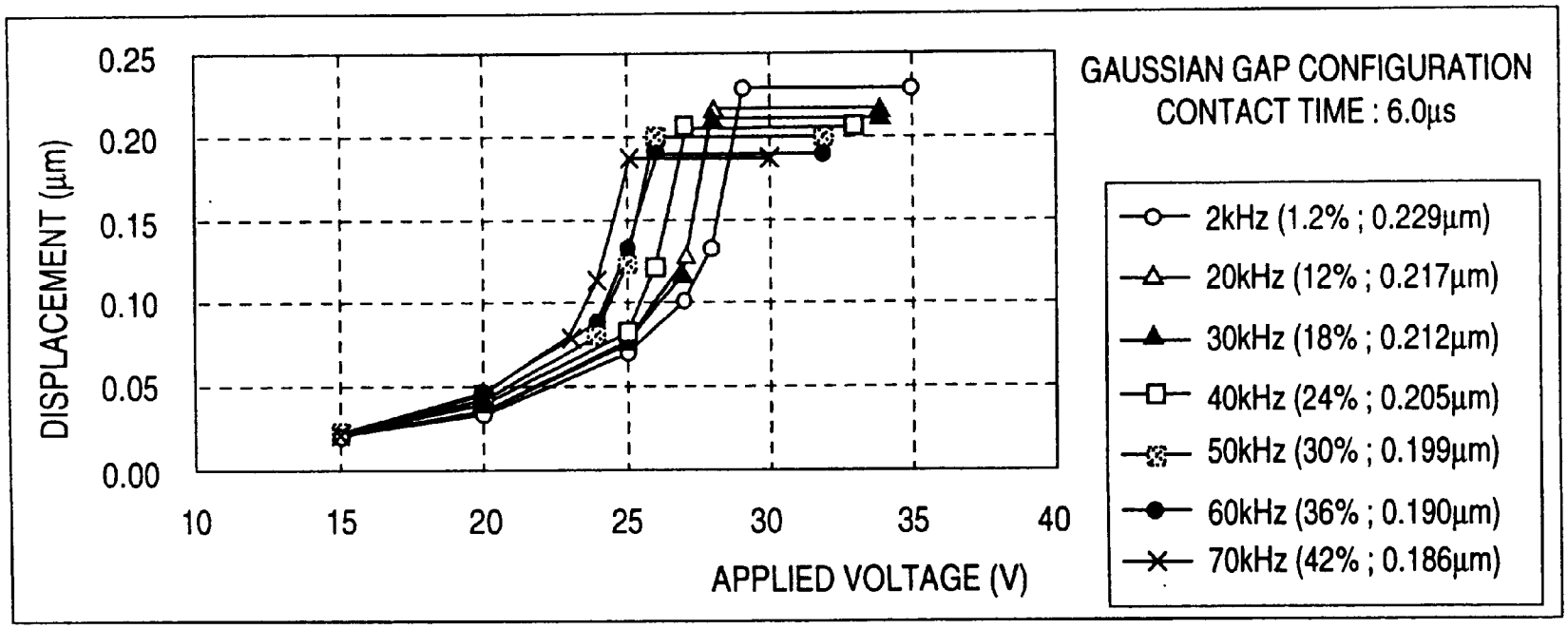
FIG. 18 shows a frequency dependence in an electrostatic ink jet head having a Gaussian gap configuration and a contact time of 6.0 μs.
Figure 19:
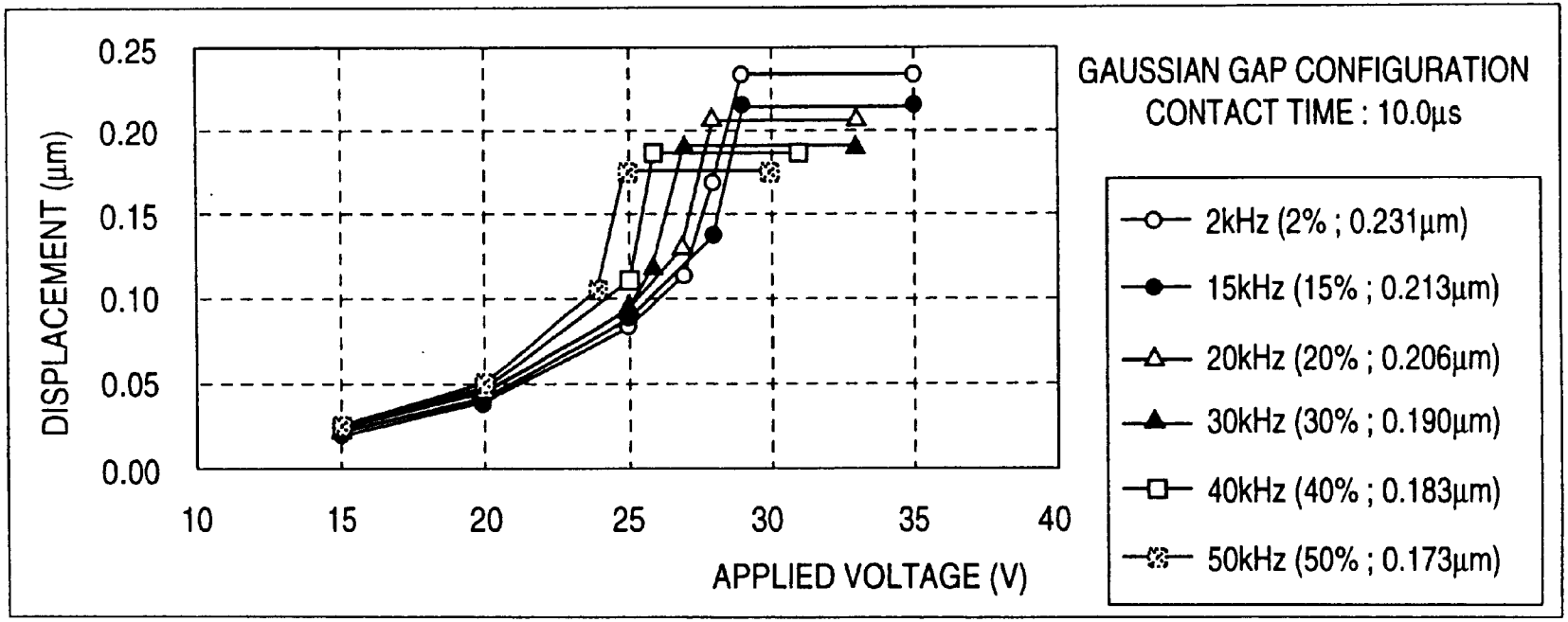
FIG. 19 shows a frequency dependence in an electrostatic ink jet head having a Gaussian gap configuration and a contact time of 10.0 μs.
Figure 20:
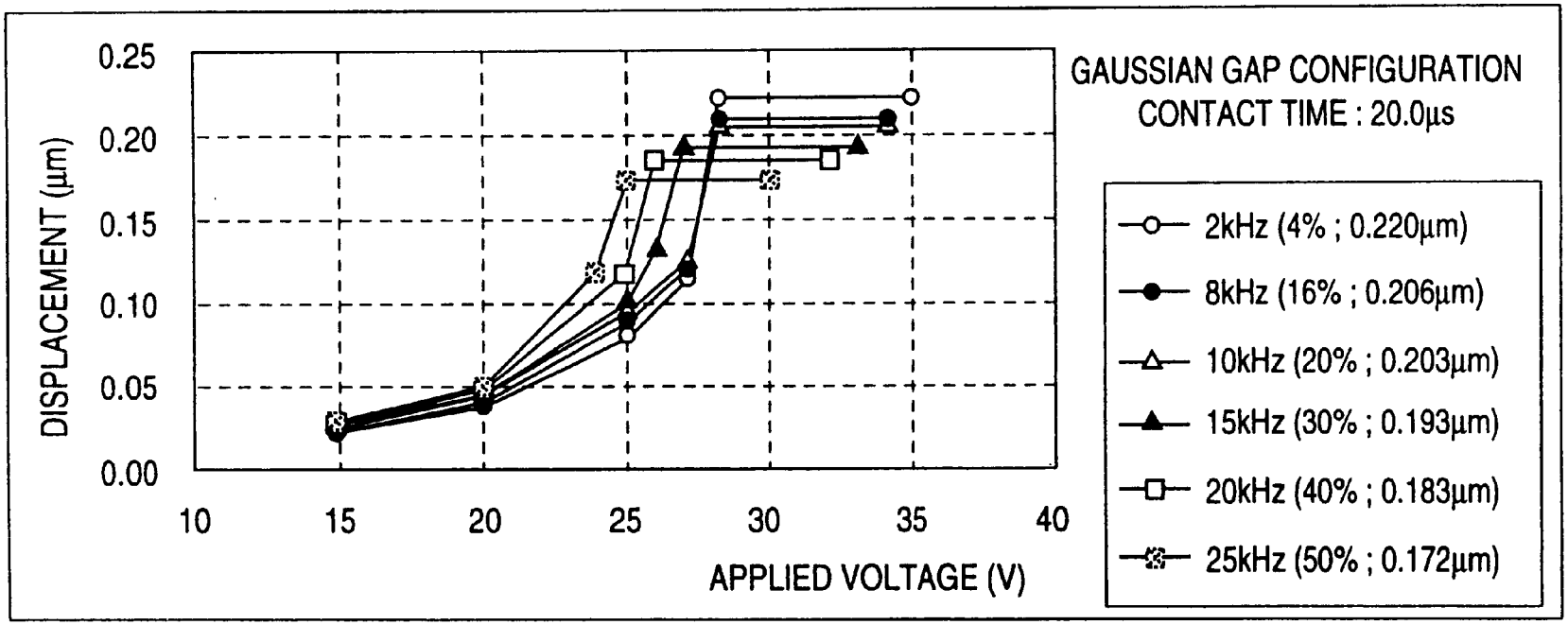
FIG. 20 shows a frequency dependence in an electrostatic ink jet head having a Gaussian gap configuration and a contact time of 20.0 μs.
Figure 21:
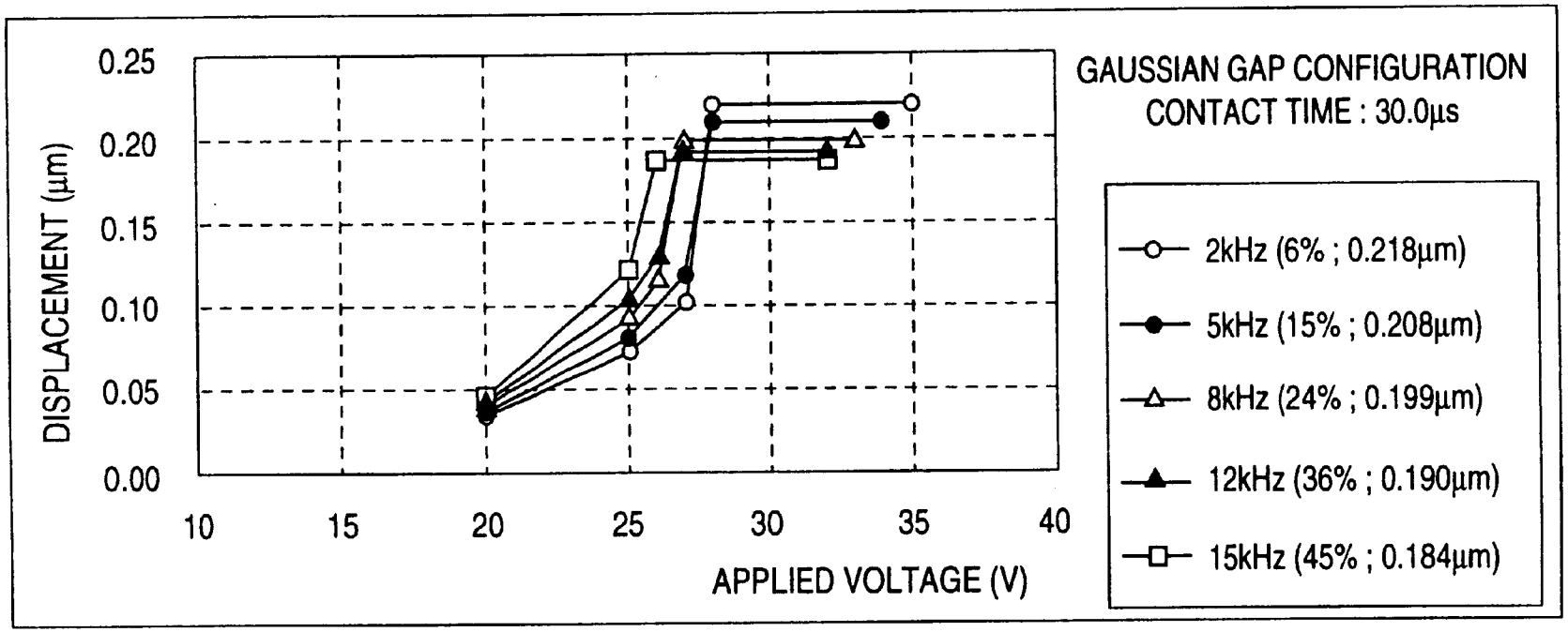
FIG. 21 shows a frequency dependence in an electrostatic ink jet head having a Gaussian gap configuration and a contact time of 30.0 μs.

FIGS. 14 to 21 show data obtained from additional experiments. In these experiments, the contact time is constant, and the driving voltage and displacement of the diaphragm are changed as the driving frequency is made higher. FIGS. 14 to 16 show the characteristics of an ink jet head having a gap configuration (see FIG. 5A), with the contact time being 4.0 μs (FIG. 14), 6.0 μs (FIG. 15), and 10.0 μs (FIG. 16). FIGS. 17 to 21 show the characteristics of an ink jet head having a Gaussian configuration (see FIG. 5C), with the contact time being 4.0 μs (FIG. 17), 6.0 μs (FIG. 18), 10.0 μs (FIG. 19), 20 μs (FIG. 20), and 30 μs (FIG. 21). In each figure, "%" indicates the rate of the contact time, and "μm" indicates the displacement of the diaphragm in contact. The ink jet head used in the additional experiments shown in FIGS. 14 to 21 differs from the ink jet heat used in the experiments shown in FIGS. 6 to 13. The measurement results of the ink jet head are shown in Table 1. Here, each contact time is a contact time that is actually measured, instead of a driving voltage pulse width.

TABLE 1

| | gap length (μm) | diaphragm thickness (μm) | diaphragm width (μm) |
|---|---|---|---|
| parallel gap head | 0.20 | 2.2 | 130 |
| Gaussian gap head | 0.23 | 2.0 | 125 |

In the ink jet head having the parallel gap configuration shown in FIGS. 14 to 16, when the rate of the contact time is less than 40%, the displacement of the diaphragm is less than 10%, which hardly affects the ink discharging operation. In the ink jet head having the Gaussian gap configuration shown in FIGS. 17 to 21, when the rate of the contact time is less than 20%, the displacement of the diaphragm is less than 10% (10.82% in FIG. 19), which hardly affects the ink discharging operation.

Figure 22:
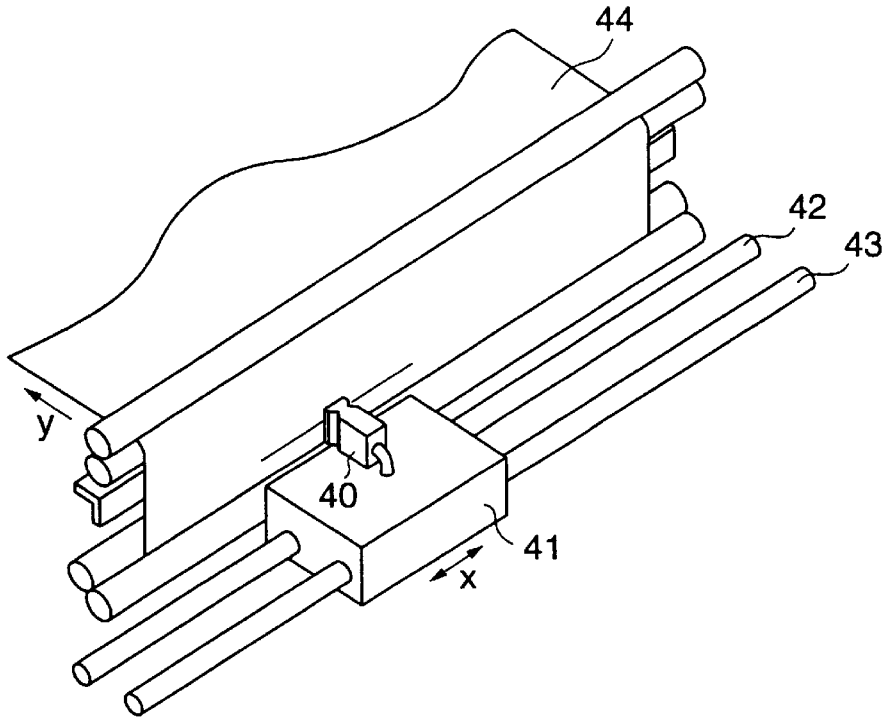
FIG. 22 is a perspective view of an ink jet recording apparatus on which an electrostatic ink jet head of the present invention is mounted.

FIG. 22 is a schematic view of an ink jet recording apparatus on which an electrostatic ink jet head of the present invention is mounted. In this figure, reference numeral 40 indicates an ink jet recording head, reference numeral 41 indicates a carriage on which the ink jet recording head is mounted and reciprocates the ink jet recording head 40 in the direction of the arrow X, reference numeral 42 indicates a driving shaft that reciprocates the carriage 41 in the direction of the arrow X, reference numeral 43 indicates a guide rod that guides the reciprocating motion of the carriage 41, and reference numeral 44 indicates recording paper. As already known, the reciprocating motion of the carriage reciprocates the ink jet recording head 40 in the direction of the arrow X, and the movement of the recording paper 44 in the direction of the arrow Y transfers desired characters and figures onto the recording paper 44.

Figure 23:
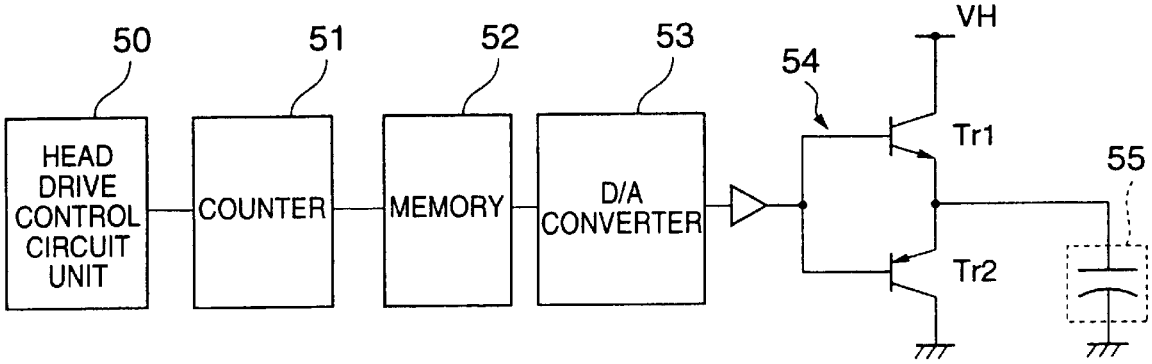
FIG. 23 illustrates a driving voltage pulse generator circuit used in the present invention.

FIG. 23 is a schematic view of a head driving circuit suitable for driving an electrostatic ink jet head of the present invention. This head driving circuit comprises a head drive control circuit unit 50, a counter 51, a memory 52, a D/A converter 53, an amplifier 54, and a head unit (actuator) 55. The head drive control circuit unit 50 selects and outputs one of driving voltage waveforms that are stored in advance. The counter 51 and the memory 52 select an actuator to be driven, and the D/A converter 53 converts the digital output signal from the memory 52 into an analog signal. The amplifier 54 then amplifies the analog signal, and drives the actuator 55.

The present invention is not limited to the specifically disclosed embodiments, but variations and modifications may be made without departing from the scope of the present invention.

The present invention is based on Japanese patent application No. 2000-095378 filed on Mar. 30, 2000, the entire contents of which are hereby incorporated by reference.

What is claimed is:

1. An electrostatic ink jet head that includes a plurality of electrostatic actuators, each of said plurality of electrostatic actuators comprising:

a nozzle;

an ink liquid chamber that communicates with the nozzle;

a diaphragm; and an electrode that faces the diaphragm, with a predetermined space being maintained between the electrode and the diaphragm, wherein a voltage is applied between the electrode and the diaphragm so as to deform the diaphragm due to static electricity, ink droplets are discharged by a mechanical recovering force of the deformed diaphragm, the electrode and the diaphragm form a non-parallel gap, and when the voltage is applied, a period of time during which the diaphragm is in contact with the electrode is 20% or less of a period of time required for forming one pixel.

2. An electrostatic ink jet head that includes a plurality of electrostatic actuators, each of said plurality of electrostatic actuators comprising:

a nozzle;

an ink liquid chamber that communicates with the nozzle;

a diaphragm; and an electrode that faces the diaphragm, with a predetermined space being maintained between the electrode and the diaphragm, wherein a voltage is applied between the electrode and the diaphragm so as to deform the diaphragm due to static electricity, ink droplets are discharged by a mechanical recovering force of the deformed diaphragm, the electrode and the diaphragm form a non-parallel gap, a relationship, $V1/V=0.7$, is satisfied, a volume of the gap chamber formed by a space closed or approximately closed by the diaphragm and the electrode being V, and a volume of a diaphragm chamber being V1, the diaphragm chamber being partially the gap chamber and a space just under the diaphragm, and when the voltage is applied, a period of time during which the diaphragm is in contact with the electrode is 20% or less of a period of time required for forming one pixel.

* * * * *